US007883293B2

(12) United States Patent
Paulsen

(10) Patent No.: US 7,883,293 B2
(45) Date of Patent: Feb. 8, 2011

(54) CONNECTOR ASSEMBLY FOR AN OFF SHORE RISER

(75) Inventor: Ole K. Paulsen, Arendal (NO)

(73) Assignee: Sandvik Intellectual Property AB, Sandviken (SE)

( * ) Notice: Subject to any disclaimer, the term of this patent is extended or adjusted under 35 U.S.C. 154(b) by 290 days.

(21) Appl. No.: 11/989,232

(22) PCT Filed: Apr. 3, 2007

(86) PCT No.: PCT/SE2007/050213

§ 371 (c)(1),
(2), (4) Date: Jan. 23, 2008

(87) PCT Pub. No.: WO2007/117209

PCT Pub. Date: Oct. 18, 2007

(65) Prior Publication Data

US 2009/0097926 A1 Apr. 16, 2009

(30) Foreign Application Priority Data

Apr. 7, 2006 (SE) ..... 0600827
Aug. 17, 2006 (SE) ..... 0601693

(51) Int. Cl.
*F16L 19/06* (2006.01)
*F16L 1/12* (2006.01)
*E21B 17/01* (2006.01)

(52) U.S. Cl. ..... 405/169; 405/195.1; 277/607; 277/611; 277/616

(58) Field of Classification Search ..... 405/195.1, 405/169, 170, 224.2; 277/338, 339, 607, 277/611, 616, 626
See application file for complete search history.

(56) References Cited

U.S. PATENT DOCUMENTS 3,507,506 A * 4/1970 Tillman ..... 277/614
3,721,291 A * 3/1973 Massaro et al. ..... 165/158
4,477,093 A * 10/1984 Adamek ..... 277/322
4,491,439 A * 1/1985 Watkins ..... 405/224
5,016,920 A 5/1991 Anderson (Continued)

FOREIGN PATENT DOCUMENTS

AT 392 143 1/1991

(Continued)

*Primary Examiner*—Tara Mayo-Pinnock
(74) *Attorney, Agent, or Firm*—Drinker Biddle & Reath LLP

(57) ABSTRACT

Connector assembly adapted to connect riser member of riser device to another riser member for connecting an oil well to an oil rig includes a male part having a male axial portion and a female part having a female axial portion opposite to said male axial radial portion, which together form a seat. A sealing ring having a radially extending annular stem provided with first and second axial seal support portions, and a radial annular portion interconnecting said first and second seal support surfaces being axially separated. Said radially extending annular stem has a first axial seal support portion adapted at atmospheric pressure to abut said male axial portion and a second axial seal support portion adapted during use to abut said female axial portion.

28 Claims, 9 Drawing Sheets

U.S. PATENT DOCUMENTS

| | | | | |
|---|---|---|---|---|
| 5,039,140 | A * | 8/1991 | Szymczak | 285/334.2 |
| 5,103,915 | A * | 4/1992 | Sweeney et al. | 166/379 |
| 5,165,822 | A | 11/1992 | Hein | |
| 5,466,018 | A * | 11/1995 | Stobbart | 285/334.2 |
| 5,845,945 | A * | 12/1998 | Carstensen | 285/321 |
| 6,524,032 | B2 * | 2/2003 | Russell et al. | 405/251 |
| 6,561,521 | B2 * | 5/2003 | Janoff et al. | 277/603 |
| 6,722,426 | B2 * | 4/2004 | Sweeney et al. | 166/115 |
| 6,732,762 | B2 * | 5/2004 | Russell | 138/89 |
| 6,932,355 | B1 * | 8/2005 | Hjertholm | 277/614 |
| 6,962,206 | B2 * | 11/2005 | Hirth et al. | 166/387 |
| 2008/0175672 | A1 * | 7/2008 | Fraser | 405/170 |

FOREIGN PATENT DOCUMENTS

| | | |
|---|---|---|
| GB | 2 361 275 | 10/2001 |
| NO | 303 150 | 6/1998 |

* cited by examiner

CONNECTOR ASSEMBLY FOR AN OFF SHORE RISER

CROSS REFERENCE TO RELATED APPLICATIONS

This application is the National Stage Application of International Application No. PCT/SE2007/050213, filed Apr. 3, 2007, and claims benefit of Swedish Application Nos. 0600827-0 filed Apr. 7, 2006 and 0601693-5 filed Aug. 17, 2006.

TECHNICAL BACKGROUND OF THE INVENTION

The present invention relates to a connector assembly adapted to connect a riser to member of a riser device to another riser member for connecting an oil well to an oil rig, comprising a male part and a female part together forming a seat, said male part comprising a male axial portion, said female part comprising a female axial portion opposite to said male axial radial portion, said sealing ring comprising a radially extending annular stem provided with a first and a second axial seal support portion, said axial annular portion interconnecting said first and second seal support surfaces being axially separated, wherein a first axially extending portion extends in a direction axially away from said first seal support surface and a second axially extending portion extends in a direction axially away from said second seal support surface.

Such a connector assembly is known from U.S. Pat. No. 6,932,355. Other examples of sealing rings, connectors and connector assemblies are described in EP-A-0 412 677, GB-B-2 361 275, AT-B-392 143 and NO-B-303 150.

All the above defined prior art connector assemblies reside in the drawback that the sealing is not tight at all occurring internal work pressures.

SUMMARY OF THE INVENTION

One object of the present invention is to provide a sealing ring and a connector that is tight at all possibly occurring work pressures.

This has been achieved by a connector assembly of the initially defined kind, wherein said radially extending annular stem is provided with a first axial seal support portion adapted at atmospheric pressure to abut said male axial portion and furthermore a second axial seal support portion adapted during use to abut said female axial portion. Hereby, a defined position of the seal is achieved.

Suitably, said radially extending annular stem is provided with a radial annular portion extending between said first axial seal support portion and said second axial seal support portion, said female part being provided with a female annular radial portion extending in a direction from said female axial portion towards said male part, said radial annular portion being adapted to be arranged to form a gap together with said female annular radial portion at atmospheric pressure.

Preferably, said radial annular portion and said female annular radial portion will contact one another when subjected to an internal over pressure in the range of 3,000 psi to 15,000 psi.

Suitably, said radial annular portion of the sealing ring is substantially flat and is provided with a first annular groove for an O-ring. Furthermore, said female annular radial portion is provided with a second annular groove for said O-ring. Alternatively, the radial surface and said female annular radial portions are threaded.

Hereby is achieved that the sealing ring can be held in place in the female part before connection of the male part to the female part.

Alternatively, if there is no need to actively keep the sealing ring in place, the radial surface and said female annular radial portions are flat.

Preferably, said second annular groove is slanted in a direction away from the female part. Hereby is achieved a simplified connection of the sealing ring to the female part.

Suitably, each one of the first axial seal support portion, the second axial seal support portion, the male axial portion and the female axial portion is substantially flat.

Preferably, said first axial seal support portion contacts said male axial portion and said second axial seal support portion contacts said female axial portion at atmospheric pressure.

Hereby is achieved a controlled pressure on the sealing ring in an axial direction.

Suitably, a play is formed between said first axial seal support portion and said male axial portion, and furthermore between said second axial seal support portion and said female axial portion when subjected to an internal over pressure in the range of 3,000 psi to 15,000 psi.

Suitably, said further male axial portion is arranged at an axial distance in a direction away from said male axial portion and in a direction away from said further female axial portion.

Preferably, an annular slanting portion is provided to interconnect said further male axial portion and said male axial portion.

Suitably, said first and second axially extending portions of said sealing ring are oppositely directed, said first axially extending portion being provided with a first end portion and said second axially extending portion being provided with a second end portion, said first and second end portions constituting opposite axial ends, said sealing further being provided with an inner annular radial portion, extending from said first end portion to said second end portion, said inner annular radial portion having a substantially constant diameter.

Preferably, the radial size of the first and second radially extending portions is such that inner annular radial portion of the sealing ring is at atmospheric pressure arranged at a peripheral radial distance from an annular interior surface of said male part and said female part, respectively. Suitably, said distance is 0.5-1.5 mm. In particular, said distance is 1 mm. Alternatively, said distance is larger than 0.5 mm. Hereby is avoided that the sealing ring be damaged by the oil drill.

Suitably, the first and second axially extending portions are provided with a first and a second axially slanting surface, respectively, slanting in a direction away from said stem, said first and second axially extending portions forming an angle with said inner annular radial portion, respectively.

Preferably, the first and second axially extending portions are adapted to co-operate with said seat having first and second sloping portions having an angle in relation to the axial extension of the riser member, respectively, wherein the angle of the first and second sloping portions is larger than the angle of said first and a second axially slanting surface, respectively, wherein the lower limit of the angle difference of the first and second sloping portions and first and a second axially slanting surface, respectively, is substantially 2.5°, and the upper limit of the angle difference of the first and second sloping portions and first and a second axially slanting surface, respectively, is substantially 6°.

Hereby, a tight seal is achieved for polymeric seals

In particular, the lower limit of the angle difference of the first and second sloping portions and first and a second axially slanting surface, respectively, is substantially 2.5°, and the upper limit of the angle difference of the first and second sloping portions and first and a second axially slanting surface, respectively, is substantially 3.5°. Even more particular, the lower limit of the angle difference of the first and second sloping portions and first and a second axially slanting surface, respectively, is substantially 2.5°, and the upper limit of the angle difference of the first and second sloping portions and first and a second axially slanting surface, respectively, is substantially 3°.

Hereby, a tight seal for seals made of metal or a polymer is achieved.

Preferably, the axial extension of said stem is 14-16 mm, said first and second axially portions extending axially 5-20 mm more particularly 11-13 mm, respectively, from said stem. In particular, the axial extension of said stem is substantially 15 mm, said first and second axially portions extending axially substantially 12 mm, respectively, from said stem. Hereby, optimal proportions of the sealing ring are achieved.

Suitably, said first and second sloping portions are connected to said male and female axial portions, respectively, via an annular chamfer. Hereby, a moment that could otherwise cause the stems of the sealing ring to flex away from the seat, in turn causing leakage, is avoided.

Preferably, the modulus of elasticity of at least the first and second axially slanting surfaces, respectively of the sealing ring is lower than the modulus of elasticity of at least the first and second sloping portions of the male and female parts. Hereby, is achieved that float of the material of the sealing ring is achieved. Furthermore is achieved that damage of the connector is prevented.

Suitably, at least the first and second axially slanting surfaces, respectively are made of Titanium or a stiff plastic material such as peak plastics and at least the first and second sloping portions are made of steel.

Alternatively, at least the first and second axially slanting surfaces, respectively are made a steel alloy having a low modulus of elasticity and at least the first and second sloping portions are made of a steel alloy having a high modulus of elasticity.

Alternatively, the modulus of elasticity of the sealing ring is lower than the modulus of elasticity of the male and female parts. In particular, the sealing ring is made of Titanium or a stiff plastic material such as peak plastics, i.e. a plastic material of high quality, and said male and female parts are made of steel. Alternatively, the sealing ring is made a steel alloy having a low modulus of elasticity and said male and female parts are made of a steel alloy having a high modulus of elasticity. Hereby, is also achieved that float of the material of the sealing ring is achieved, and that damage of the connector is prevented.

DRAWING SUMMARY

In the following, the invention will be described in more detail with reference to the accompanying drawings, in which FIG. 1A illustrates in an exploded view of a riser assembly having a first riser provided with a male part including a grip protection device and a female part, a second riser with such a male part and a third riser with such a female part;

DETAILED DESCRIPTION

Figure 1A:
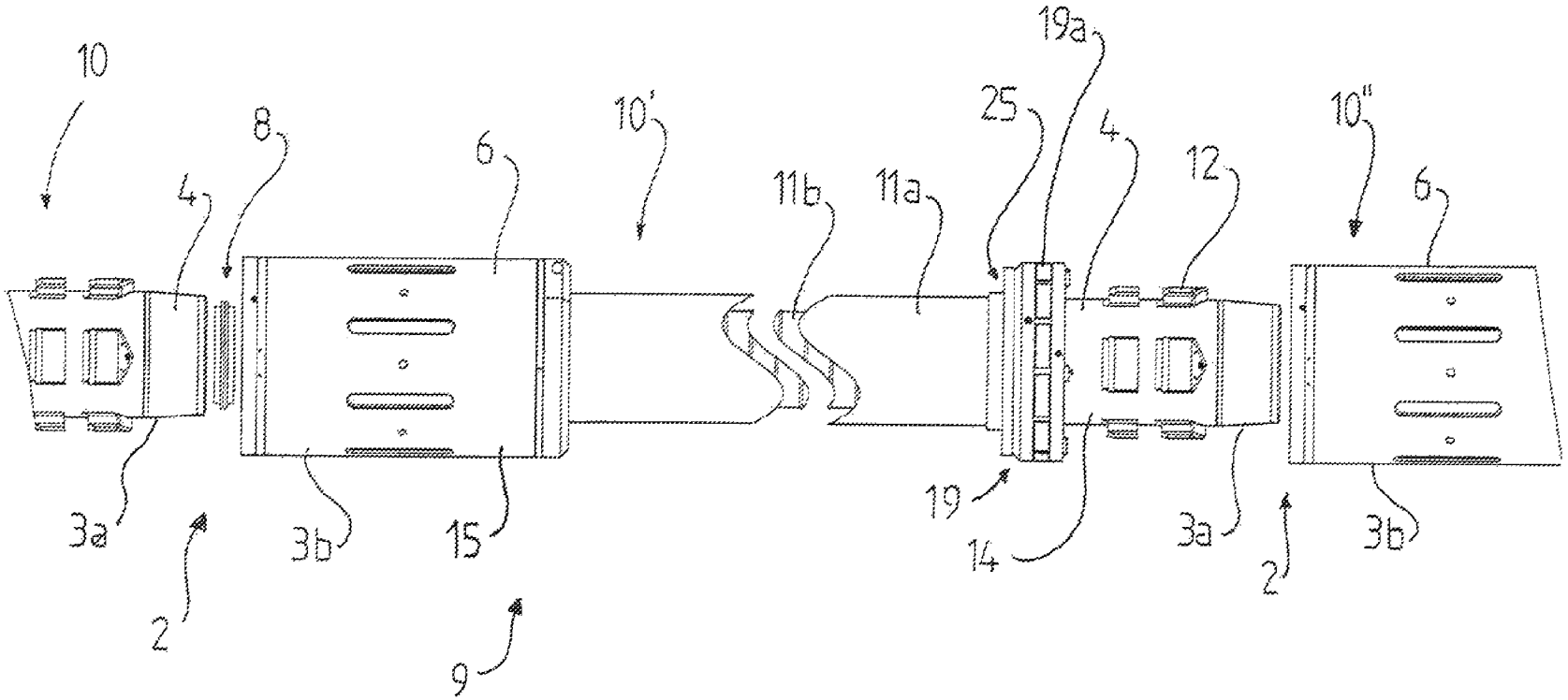
FIG. 1B is an axial cross-section of the riser assembly shown in FIG. 1A.
FIG. 1C illustrates a locking device.
Figure 1B:
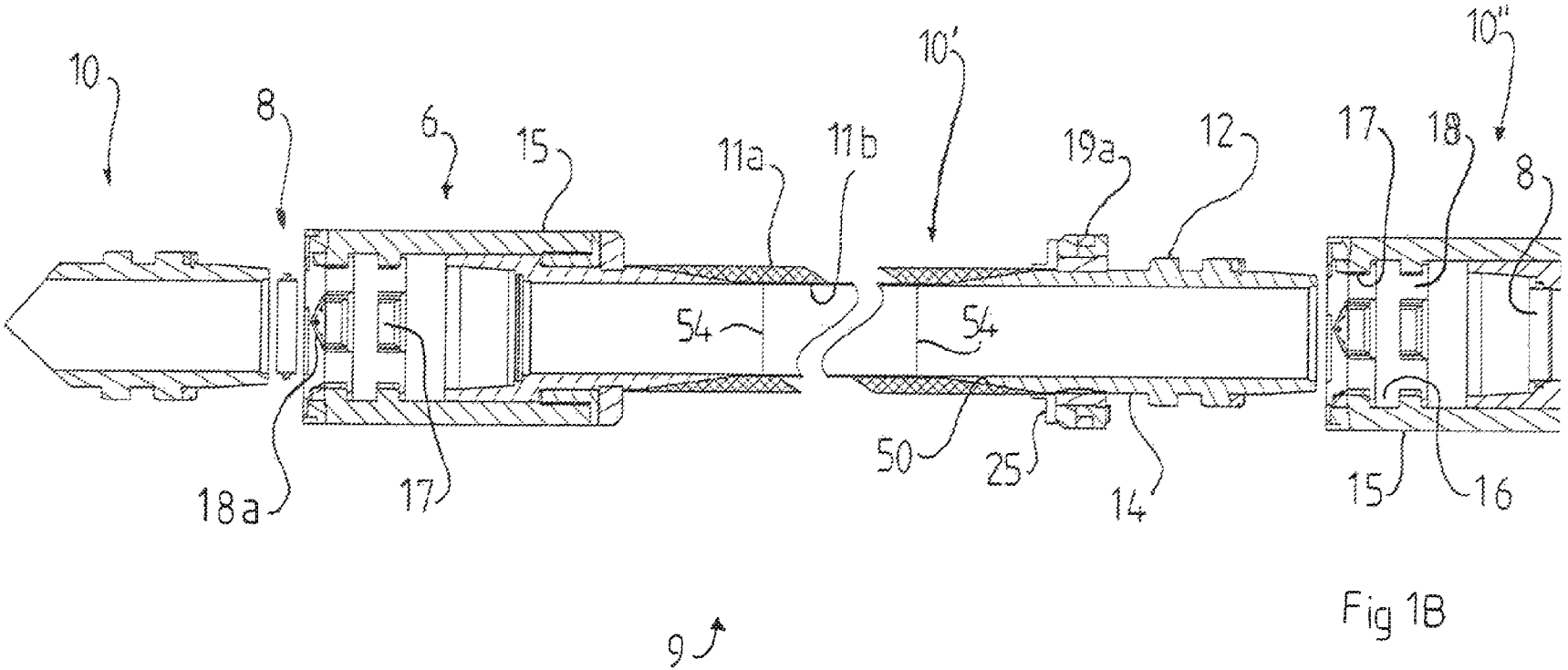

FIGS. 1A-1B show a riser assembly 9, each riser 10 constituting a combined guide and oil tubing. When used as guide tubing, it guides a drill shaft for drilling a hole to an oil well, whereas when used as oil tubing, it delivers the oil in the well up to the off-shore oil rig.

The riser 10 comprises a tubing 11*a* made of a composite material, such as carbon fibre or glass fibre, and a lining 11*b*, made of metal, such as steel. The lining protects the tubing 11*a* from wear by the drill shaft. Preferably, for work pressure of 15,000 psi, the wall thickness of the tubing 11*a* is 22 mm, whereas the wall thickness of the lining is 5 mm. Such a riser reduces the weight by 1000-2000 kg, compared to a corresponding riser made of steel.

The riser 10 further comprises at one of its ends 3*a* a male part 4 of a connector 2, and at its other end 3*b* a female part 6 of the next connector 2, connecting to a further riser 10', 10" etc. Closest to the oil well, a male part 4 is connected to a sub sea equipment, such as a blow out preventer.

At assembly of the risers 10, 10', 10" the lowermost riser 10 is held vertically at a grip protection device 25 at the male part 4 and turned with its female part 6 downwards. Risers are then connected, one at a turn to the preceding riser until the male part 4 at the sub sea equipment is reached, to which the lowermost female part 6 is connected. The uppermost male part 4, which should now be at the level of an oil rig or the like, is connected to a topside equipment, such as a riser slip, a tension system or a processing facility.

A sealing ring 8 is provided for sealingly connecting the female part of a riser 10 to the male part of a further riser 10. All parts of the connector 2, i.e. the male part 4, the female part 6 are made of steel, whereas the sealing ring 8 is made of metal, such as titanium, or a suitable polymer, such as polytetrafluoroethylene (PTFE).

The connector 2 is preferably of the bayonet kind. For this purpose, the male part 4 is provided with two rows of load receiving tabs 12, each row having four load receiving tabs annularly arranged about the circumference of the exterior surface 14 of the male part 4. The female part 6 is furthermore provided with a turnable sleeve 15, adapted to be turned clockwise about 45°.

Figure 2A:
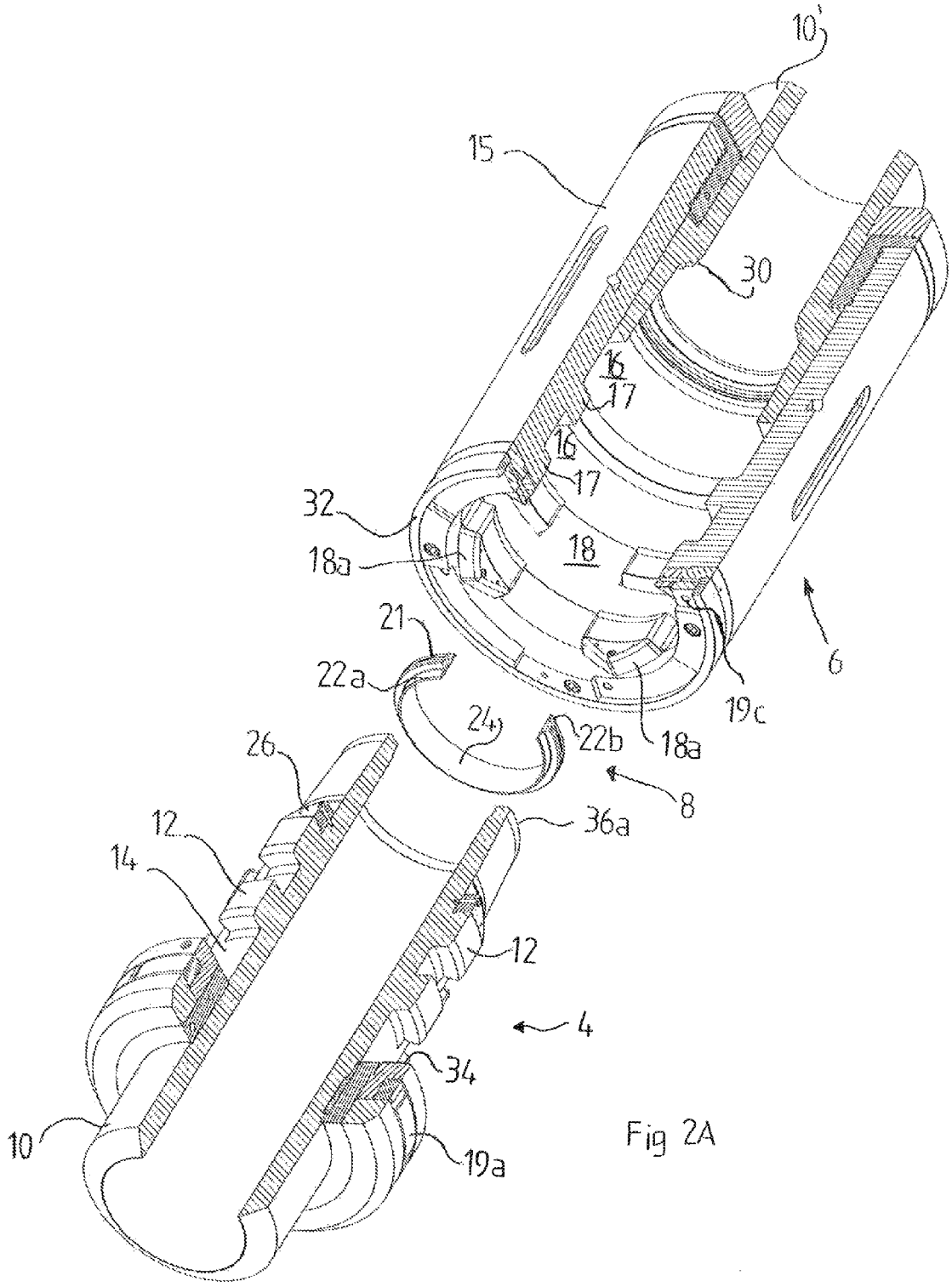
FIG. 2A is perspective view of a connector comprising the male part of the first riser and the female part of the second riser and the sealing ring shown in FIG. 1A.

The female part 6 is provided with a pair of corresponding annular grooves 16 defining load receiving members 17 and furthermore guide tracks 18 in the form of axially arranged grooves in said load receiving members 17 (see also FIG. 2A). The purpose of the guide tracks 18 are to guide the pair of annularly arranged load receiving tabs 12 to the predetermined annular groove 16, respectively, during insertion of the male part 4 in the female part 6. In order to further facilitate said insertion, the female part 6 is provided with guide members 18*a*. While turning the sleeve 15, the load receiving members 17 are placed behind the load receiving tabs 12.

Figure 1C:
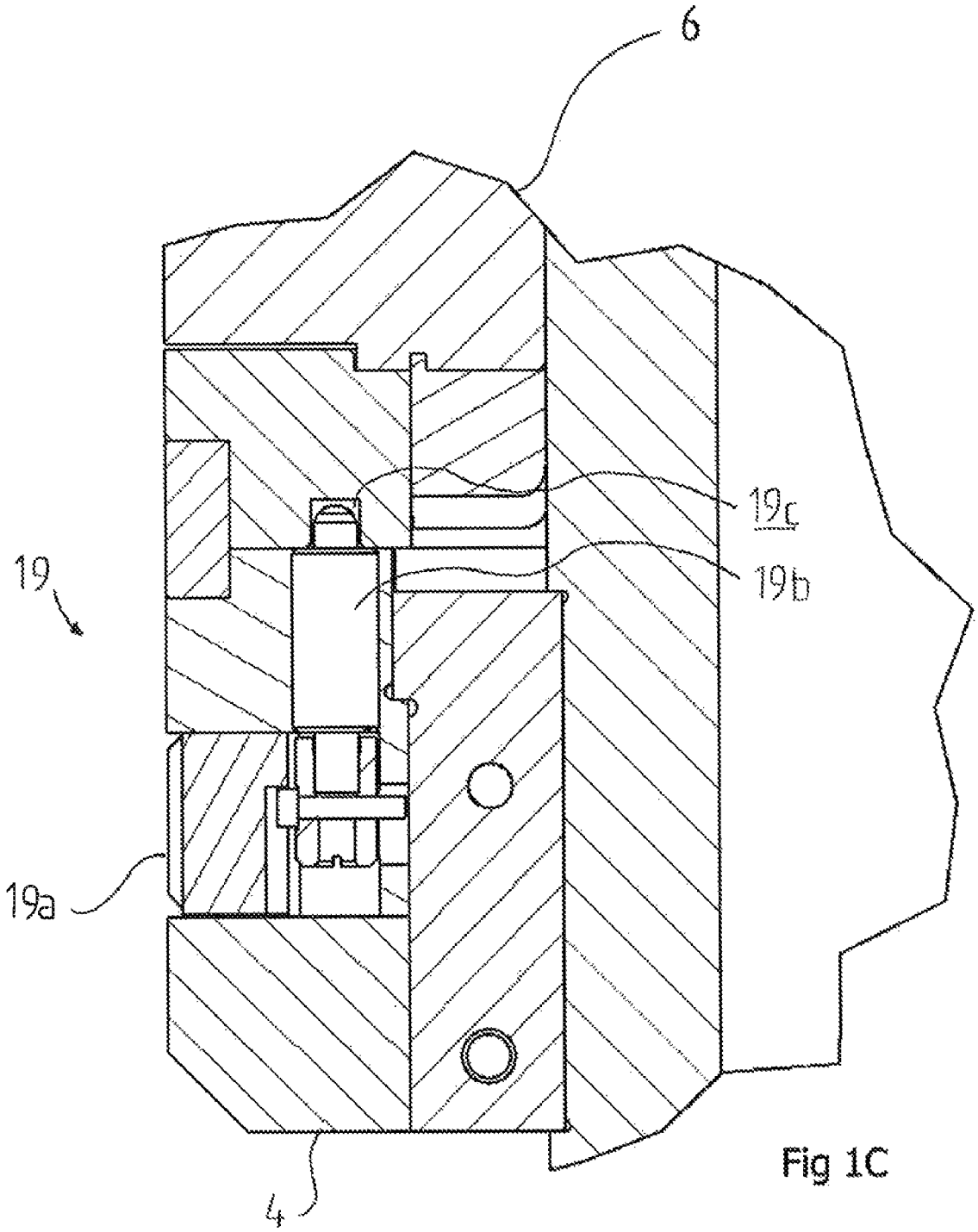

FIG. 1C shows a locking means 19 provided on the male part 4 in the form of a rotatable ring 19*a* and an axially movably locking member 19*b*, and on the female part 6 in the form of an opening 19*c* (see also FIG. 2A). While turning the rotatable ring 19*a* counter-clockwise about 45°, the locking member protrudes into the opening 19*c* of the sleeve 15, such that the sleeve 15 is prevented from rotating to an open state by vibration.

When opening the connector 2, the rotatable ring 19*a* is turned in the opposite direction, i.e. clockwise, causing the locking member 19*b* to be withdrawn from the opening 19*c* in sleeve 15. Now, the sleeve 15 can be turned counter-clockwise to move the load receiving members away from the load receiving tabs 17, such that they can be slid through the guide tracks 18 and thereby release the male and female parts 4, 6 from one another.

A grip protection device 25 (omitted in FIG. 2A) in the form of a radially extending collar is provided at the locking ring 19*a* for protecting the connector 2 and the tubing 11*a* when lifting, holding and lowering the riser 10, in particular during connection and disconnection of a pair of risers 10, respectively. The grip protection device 25 is bolted, glued or welded to the riser.

FIG. 2A shows the male and the female parts 4, 6 and the sealing ring 8 at assembly of the connector 2. The load receiving tabs 12 closest to the female part 6, seen in the axial direction of the connector when disassembled, are provided with a guide member 26 for facilitating insertion of the load receiving tabs 12 in the guide tracks 18 provided closest to the male part 4 seen in the axial direction of the connector when disassembled.

Figure 2B:
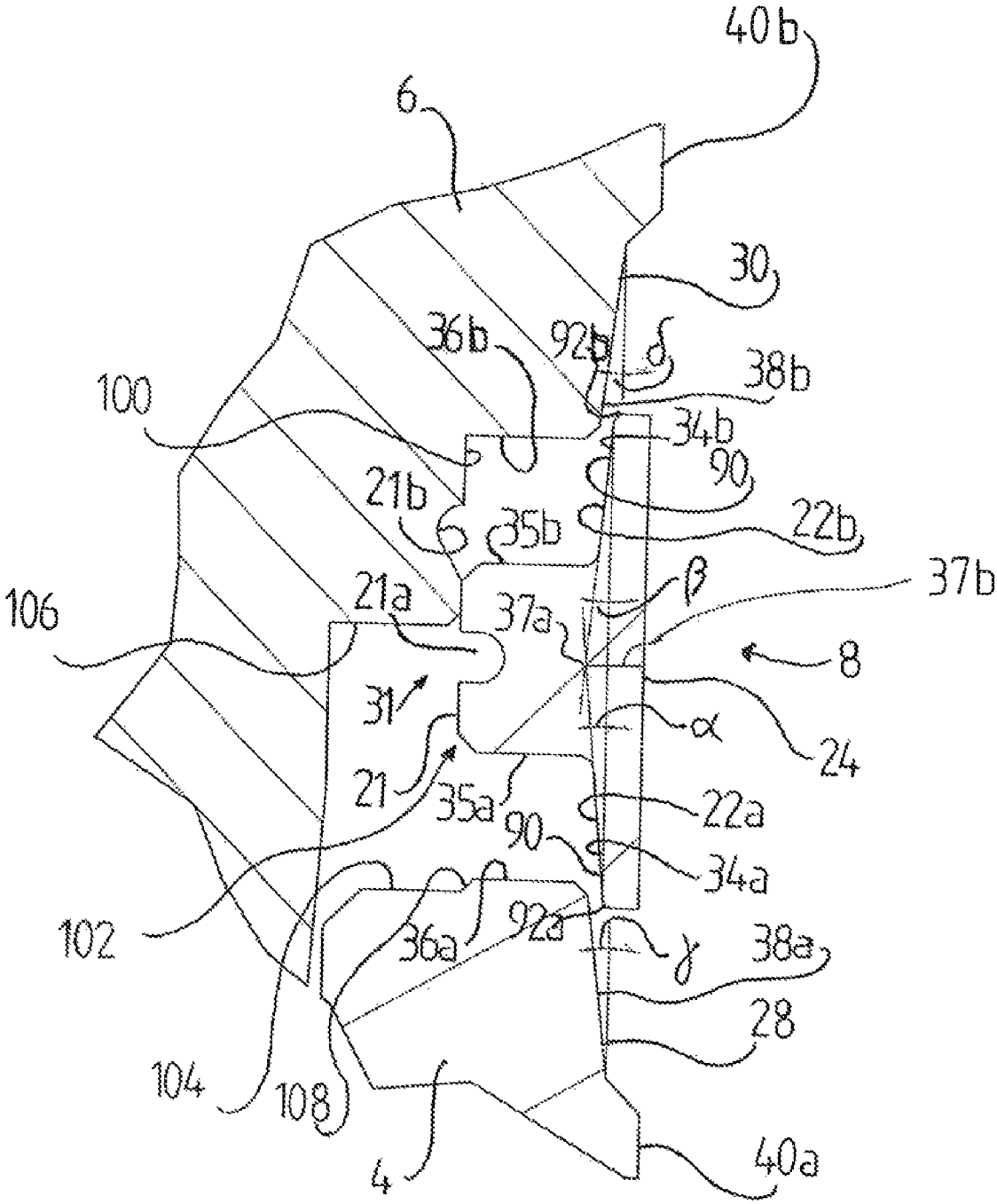
FIG. 2B is a cross-section in-part of an exploded view of the male and the female parts of the connector and the sealing ring.

The sealing ring 8 is provided with a stem 102 having a radially extending central portion 21 having on each axial side a seal support surface 35*a*, 35*b* (see FIG. 2B). The sealing ring 8 is furthermore provided with a pair of axially extending portions 22*a*, 22*b*. The central portion 21 and the axially extending portions 22*a*, 22*b* have a common interior surface, an inner annular portion 24. The sealing ring 8 is provided at its central portion 21 with an annular groove 21*a*, adapted to receive an O-ring 94 (see FIG. 2C) made of a suitable metal or a suitable polymer.

The male and female parts 4, 6 are furthermore provided with a seat 28, 30 for the axially extending portion 22*a*, 22*b*, respectively.

In FIG. 2B is shown the sealing ring 8 in relation to the male and female parts 4, 6. The axially peripheral surface 34*a*, 34*b* of the axially extending portions 22*a*, 22*b*, slopes away from the central portion 21, at an angle α, β, respectively, towards a peripheral end 92*a*, 92*b*, respectively. Lines indicating an imaginary continuation of the axially peripheral surfaces 34*a* and 34*b* have been indicated in FIG. 2B, the intersection of said lines being denoted 37*a*. The distance from the intersection 37*a* and said inner nnular portion 24 has been denoted 37*b*. The distance 37*b* is preferably in the range of 3-5 mm, most suitably 4 mm.

An axially directed surface 40*a*, 40*b* of the male and the female part, respectively, is provided with a sloping surface 38*a*, 38*b* with angle γ, δ, respectively.

Before connection of the connection piece 2, the sealing ring 8 is placed and locked by a seal locking means 31, constituted by the groove 21*a* provided with said O-ring, and an asymmetrically arranged annular groove 21*b* in an annular part 21*c* facing the central portion 21 of the sealing ring 8, now locked in position in the female part 6, such that an axial portion 35*b* of the central portion 21 bears against an axial portion 36*b* of the female part 6.

During connection of the connection piece 2, the female part 6 is moved axially towards the male part 4, being facilitated by the guide members 18*a* and 26, such that the load receiving tabs 12 are moved through the groove 18 until an axial portion 35*a* on the other side of the central portion 21 of the sealing ring 8 bears against an axial portion 36*a* of the male part 4.

Figure 2C:
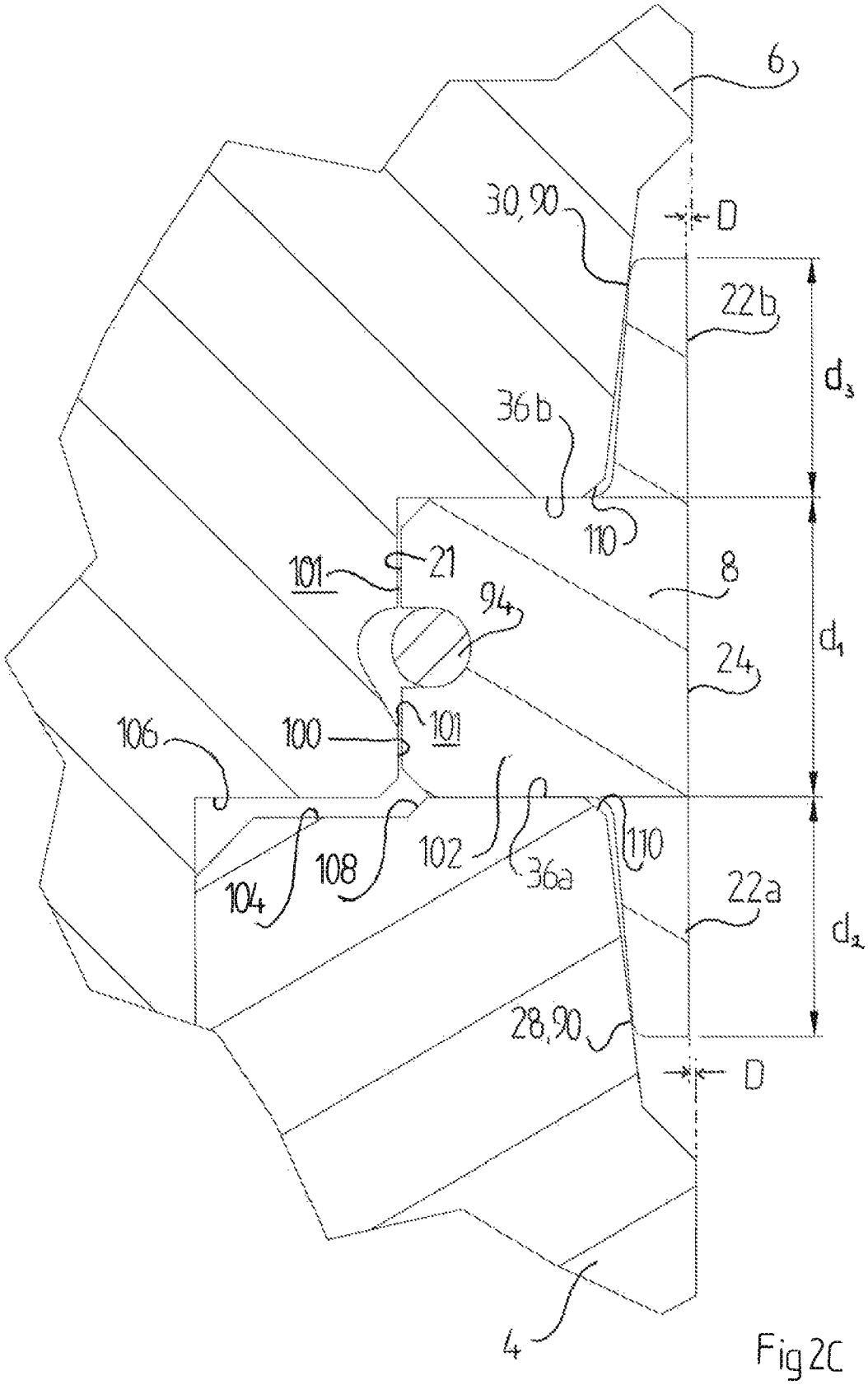
FIG. 2C illustrates the parts shown in FIG. 2B when assembled.

FIG. 2C shows the seal 8 assembled between the female part 6 and the male part 4. An O-ring 94 is provided to help keeping the sealing ring 8 in place while connecting the female part 6 to the male part 4.

As can be seen in FIGS. 2B and 2C, the female part 6 is provided with a female annular radial portion 100 that extends in a direction from the female axial portion 36*b* towards the male part 4. When in a connected state at atmospheric pressure, the central portion 21 is arranged with a small gap 101 in relation to the female annular radial portion 100.

Figure 2D:
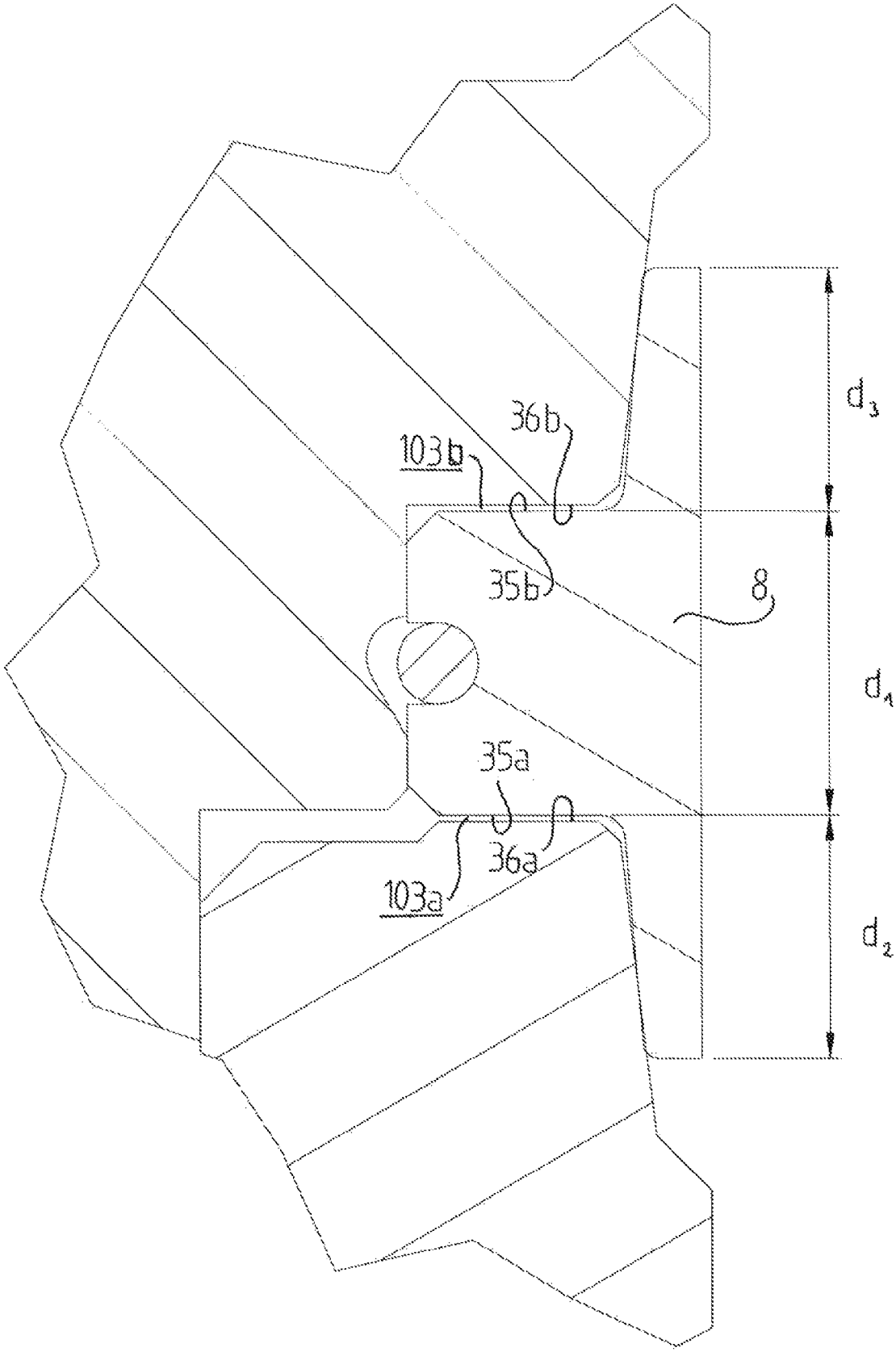
FIG. 2D illustrates the parts shown in FIG. 2C at work pressure.

In FIG. 2D is shown the riser assembly when subjected to an internal over pressure at normal work loads. The sealing ring will be pressed raidially outwards, such that the central portion 21 will contact the female annular radial portion 100, i.e. the small gap 101 will disappear.

Due to the over pressure and to the tolerances at the dogs 12 and 17, the axial portions 35*a*, 35*b* of the stem will no longer touch the axial surfaces 36*a*, 36*b*, of the male and female parts 4, 6, respectively, i.e. play 103*a*, 103*b* will occur.

Furthermore, said female part 6 is provided with a further female axial portion 106 that extends substantially radially outwards from the female annular radial portion 100. The male part 4 is provided with a further male axial portion 104 that extends substantially radially outwards from the male axial portion 36*a*. An annular slanting portion 108 is provided to interconnect the further male axial portion 104 and the male axial portion 36*a*. The further male axial portion 104 is arranged at an axial distance in a direction away from said male axial portion 36*a* and in a direction away from said further female axial portion 106. Hereby, a predetermined axial pressure can be applied to the stem 102.

The turnable sleeve 15 is then turned 45° clockwise for moving the load receiving tabs 12 behind the load receiving members 17, such that the load receiving tabs 12 and the load receiving members are able to withstand axial loads. Then the rotatable ring 19*a* is turned counter-clockwise about 45°, such that the sleeve 15 is prevented from rotating to an open state by vibration.

As can be seen in FIG. 2C, the axial extension is denoted $d_1$, while the axial extension of the first and second axially extending portions 22*a*, 22*b* from the stem 102 in either directions is denoted $d_2$ and $d_3$, respectively.

It is preferred that axial extension $d_1$ of the stem 102 is in the range of 14-16 mm, in particular 15 mm, while the axial extension $d_2$,$d_3$ of the first and second axially portions 22*a*, 22*b* is in the range of 11-13 mm, in particular 12 mm.

The first and second sloping portions 38*a*, 38*b* are connected to the male and female axial portions 36*a*, 36*b*, respectively, via an annular chamfer 110 in order to avoid a momentum on the axially extending portions 22*a*, 22*b* that could otherwise cause leakage.

The first and second radially extending portions 22*a*, 22*b* extend radially to such an extent that at atmospheric pressure, the inner annular portion 24 of the sealing ring 8 is at atmospheric pressure arranged at a peripheral radial distance D from an annular interior surface 40*a*, 40*b* of the male part 4 and the female part 6, respectively. Wear or damage of the sealing ring by the oil drill can consequently be avoided. It is preferred that the distance D is 0.5-1.5 mm, but in particular 1 mm. In any case, it should be larger than 0.5 mm.

Figure 3A:
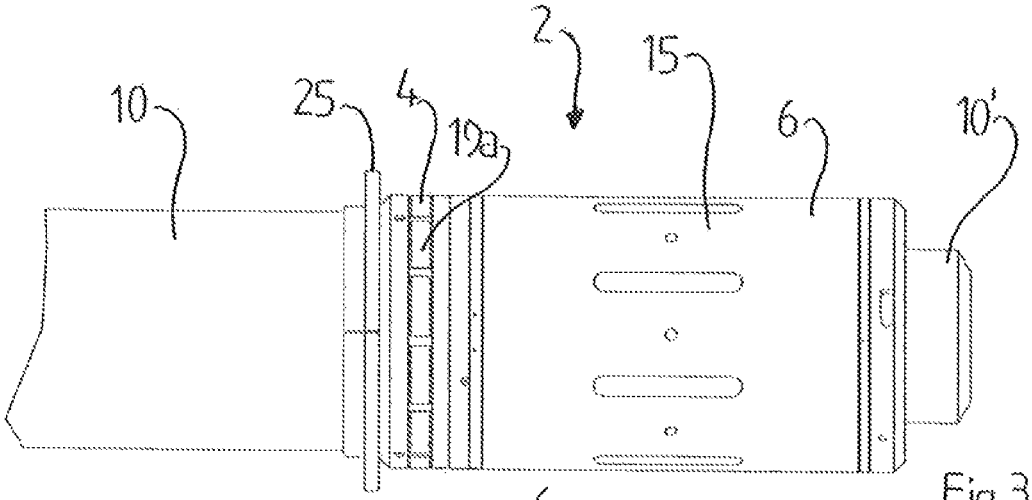
FIG. 3A illustrates the connector shown in FIG. 2A in an assembled state.

FIG. 3A shows the connector 2 in an assembled state.

Figure 3B:
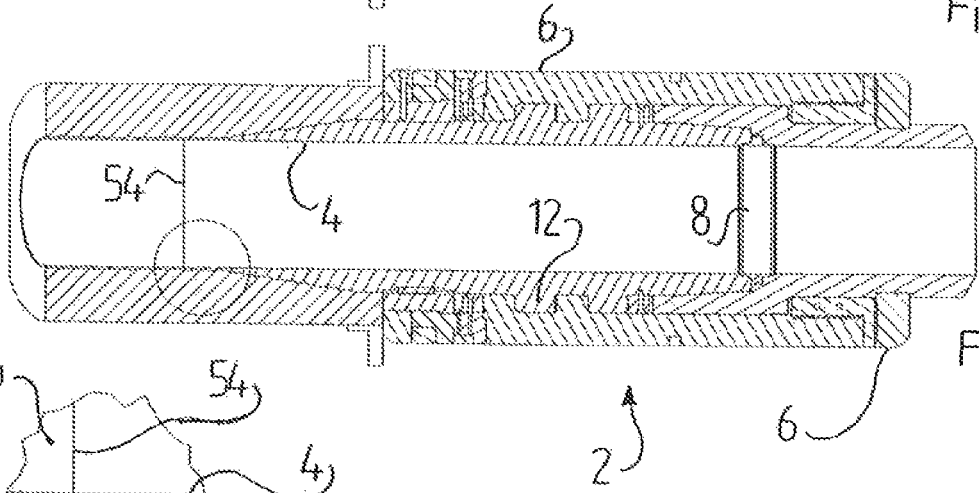
FIG. 3B is an axial cross-section of the connector shown in FIG. 3A.
Figure 3C:
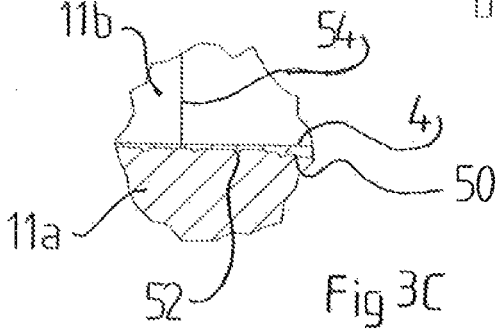
FIG. 3C is an enlargement of the encircled portion of FIG. 3B.

FIGS. 3B and 3C show how the male part 4 and the lining 11*b* are arranged in the tubing 11*a* by providing both with a corresponding conical surface 50. Furthermore, the axial periphery of the lining 11*b* and the male part 4, is provided with protrusions 52, respectively, that perform a grip in the axial inner surface of the tubing 11*a*. The male part 4 and the lining 11*b* are welded to one another at 54.

Figure 4:
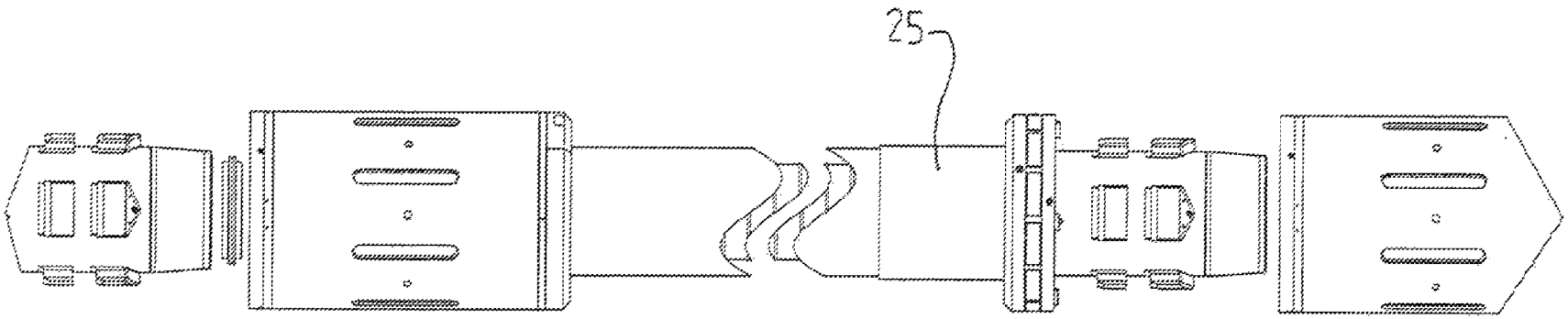
FIG. 4 illustrates the connector of a riser assembly provided with an alternative grip protection device.

FIG. 4 shows an alternative connector provided with a grip protection device 25 in the form of pair of sleeve halves bolted, welded or glued to the riser 10.

In the following a couple of differently angled sealing rings and seats are presented in four examples.

Example 1

$\gamma=7°$
$\delta=7°$
$\alpha=6.04°$
$\beta=6.04°$
From this follows that
$\gamma-\alpha=\delta-\beta=0.96°$
Leakage occurred at increased work pressure Example 2

A sealing with the following angles was tested
$\gamma=8°$
$\delta=8°$
$\alpha=5.23°$
$\beta=5.23°$
From this follows that
$\gamma-\alpha=\delta-\beta=2.67°$
No leakage occurred even at a work pressure of about 15,000 psi Example 3

A sealing with the following angles was tested
$\gamma=70$
$\delta=7°$
$\alpha=4.47°$
$\beta=4.47°$
$\gamma-\alpha=\delta-\beta=2.53°$
No leakage occurred even at a work pressure of about 15,000 psi Example 4

A sealing with the following angles was tested, the sealing being made of a polymeric material
$\gamma=7°$
$\delta=7°$
$\alpha$=about 1°
$\beta$=about 1°
$\gamma-\alpha=\delta-\beta=6°$
No leakage occurred even at a work pressure of about 15,000 psi The conclusion is that in the seal of Example 1, the contact pressure per area unit will decrease due to the fact that the increase in work pressure will causes an increase of the contact area. The larger the contact area, the larger the risk for leakage.

In the sealings of examples 2-4, proved instead to be successfully tight due to a very high contact pressure at the annular abutment portion 30, 90 and 28, 90 during mounting thereof. Furthermore, the material of the surface of the sealing ring 8 will float at the annular abutment portion of the sealing ring.

The internal oil or gas pressure, may be in the range of 3,000 to 15,000 psi. Such high pressures will cause the area of the annular abutment portion to increase in size, in turn resulting in improved seal.

It should be noted that it is the angle difference ($\gamma-\alpha$ and $\delta-\beta$, respectively) that creates annular abutment portion, not the above presented angles as such. In particular, the angle difference ($\gamma-\alpha$ or $\delta-\beta$) ranges substantially between 2.5° and 6°, while $\gamma>\alpha$ and $\delta>\beta$. Good results have been achieved with a lower limit of the angle difference of 2.5° and an upper limit of 4° regarding sealing rings made of steel and with a lower limit of the angle difference of 2.5° and an upper limit of 6° for sealing rings made of a polymeric material.

It should also be noted that the angle difference $\gamma-\alpha$ may have one value while the other angle difference $\delta-\beta$ may have another value.

It should furthermore be noted that the angle $\gamma$ may be chosen differently than the angle $\delta$. The same relates to the angles $\alpha$ and $\beta$.

In order to avoid float of the material on the seats of the male part 4 or the female part 6, the modulus of elasticity of the sealing ring 8 is chosen lower than the modulus of elasticity of the male and female parts 4, 6. This can be achieved by using steel in the connector parts, while producing the sealing ring of Titanium or a stiff plastic material such as peak plastics. Alternatively, the sealing ring could be made of a steel alloy having a low modulus of elasticity, while the male and female parts 4, 6 are made of a steel alloy having a high modulus of elasticity.

The invention claimed is:

1. A connector assembly adapted to connect a riser member of a riser device to another riser member for connecting an oil well to an oil rig, comprising:

a male part and a female part together forming a seat, said male part comprising a male axial portion, said female part comprising a female axial portion opposite to said male axial radial portion, and a sealing ring comprising a radially extending annular stem provided with a first and a second axial seal support portion and a radial annular portion interconnecting said first and second axial seal support surfaces being axially separated, wherein a first radial annular portion extends in a direction axially away from said first seal support surface and a second radial annular portion extends in a direction axially away from said second seal support surface, wherein said radially extending annular stem is provided with the first axial seal support portion adapted at atmospheric pressure to abut said male axial portion and furthermore the second axial seal support portion adapted during use to abut said female axial portion, wherein said female part is provided with a further female axial portion extending substantially radially outwards from a female annular radial portion said male part being provided with a further male axial portion extending substantially radially outwards from said male axial portion, said further female axial portion and said further male axial portion facing one another and being arranged at an axial distance from one another, wherein said further male axial portion is arranged at an axial distance in a direction away from said male axial portion and in a direction away from said further female axial portion, and wherein an annular slanting portion is provided to interconnect said further male axial portion and said male axial portion.

2. A connector assembly according to claim 1, wherein said radially extending annular stem is provided with a radial annular portion extending between said first axial seal support portion and said second axial seal support portion, said female part being provided with the female annular radial portion, which extends in a direction from said female axial portion towards said male part, said radial annular portion being adapted to be arranged to form a gap together with said female annular radial portion at atmospheric pressure.

3. A connector assembly according to claim 2, wherein said radial annular portion and said female annular radial portion will contact one another when subjected to an internal over pressure in the range of 3,000 psi to 15,000 psi.

4. A connector assembly according to claim 2, wherein said radial annular portion of the sealing ring is substantially flat and is provided with a first annular groove for an O-ring.

5. A connector assembly according to claim 4, wherein said female annular radial portion is provided with a second annular groove for said O-ring.

6. A connector assembly according to claim 5, wherein said second annular groove is slanted in a direction away from the female part.

7. A connector assembly according to claim 1, wherein each one of the first axial seal support portion, the second axial seal support portion, the male axial portion and the female axial portion is substantially flat.

8. A connector assembly according to claim 7, wherein said first axial seal support portion contacts said male axial portion and said second axial seal support portion contacts said female axial portion at atmospheric pressure.

9. A connector assembly according to claim 7, wherein a play is formed between said first axial seal support portion and said male axial portion, and furthermore between said second axial seal support portion and said female axial portion when subjected to an internal over pressure in the range of 3,000 psi to 15,000 psi.

10. A connector assembly claim 1, wherein, said first and second axially extending portions of said sealing ring are oppositely directed, said first axially extending portion being provided with a first end portion and said second axially extending portion being provided with a second end portion, said first and second end portions constituting opposite axial ends, said sealing further being provided with an inner annular portion, extending from said first end portion to said second end portion, said inner annular portion having a substantially constant diameter.

11. A connector assembly in accordance with claim 10, wherein the radial size of the first and second axially extending portions is such that inner annular portion of the sealing ring is at atmospheric pressure arranged at a peripheral radial distance from an annular interior surface of said male part and said female part, respectively.

12. A connector assembly in accordance with claim 11, wherein said distance is 0.5-1.5 mm.

13. A connector assembly in accordance with claim 11, wherein said distance is 1 mm.

14. A connector assembly in accordance with claim 11, wherein said distance is Larger than 0.5 mm.

15. A connector assembly according to claim 10, wherein the first and second axially extending portions are provided with a first and a second axially slanting surface, respectively, slanting in a direction away from said stem, said first and second axially extending portions forming an angle with said inner annular radial portion, respectively.

16. A connector assembly according to claim 10, wherein the first and second axially extending portions are adapted to co-operate with said seat having first and second sloping portions having an angle in relation to the axial extension of the riser member, respectively, wherein the angle of the first and second sloping portions is larger than the angle of said first and a second axially slanting surface, respectively, wherein the lower limit of the angle difference of the first and second sloping portions and first and a second axially slanting surface, respectively, is substantially 2.5°, and the upper limit of the angle difference of the first and second sloping portions and first and a second axially slanting surface, respectively, is substantially 6°.

17. A connector assembly according to claim 16, wherein a lower limit of the angle difference of the first and second sloping portions and first and a second axially slanting surface, respectively, is substantially 2.5°, and a upper limit of the angle difference of the first and second sloping portions and first and a second axially slanting surface, respectively, is substantially 3.5°.

18. A connector assembly according to claim 16, wherein a lower limit of the angle difference of the first and second sloping portions and first and a second axially slanting surface, respectively, is substantially 2.5°, and a upper limit of the angle difference of the first and second sloping portions and first and a second axially slanting surface, respectively, is substantially 3°.

19. A connector assembly according to claim 16, wherein the axial extension of said stem is 14-16 mm, said first and second axially portions extending axially 5-20 mm, respectively, from said stem.

20. A connector assembly according to claim 16, wherein the axial extension of said stem is 14-16 mm, said first and second axially portions extending axially 11-13 mm, respectively, from said stem.

21. A connector assembly according to claim 16, wherein the axial extension of said stem is substantially 15 mm, said first and second axially portions extending axially substantially 12 mm, respectively, from said stem.

22. A connector assembly according to claim 16, wherein said first and second sloping portions are connected to said male and female axial portions, respectively, via an annular chamfer.

23. A connector assembly according to claim 1, wherein the modulus of elasticity of at least the first and a second axially slanting surfaces, respectively of the sealing ring is lower than the modulus of elasticity of at least the first and second sloping portions of the male and female parts.

24. A connector assembly according to claim 23, wherein at least the first and a second axially slanting surfaces, respectively are made of Titanium and a stiff plastic material and at least the first and second sloping portions are made of steel.

25. A connector assembly according to claim 23, wherein at least the first and a second axially slanting surfaces, respectively are made a steel alloy having a first modulus of elasticity and at least the first and second sloping portions are made of a steel alloy having a second modulus of elasticity, wherein the first modulus of elasticity is less than the second modulus of elasticity.

26. A connector assembly according to claim 1, wherein the modulus of elasticity of the sealing ring is lower than the modulus of elasticity of the male and female parts.

27. A connector assembly according to claim 26, wherein the sealing ring is made of Titanium or a stiff plastic material and said male and female parts are made of steel.

28. A connector assembly according to claim 26, wherein the sealing ring is made a steel alloy having a low modulus of elasticity and said male and female parts are made of a steel alloy having a high modulus of elasticity.

* * * * *